United States Patent [19]

Purcupile

[11] Patent Number: 4,541,274

[45] Date of Patent: Sep. 17, 1985

[54] APPARATUS AND METHOD FOR MONITORING AND CONTROLLING A PUMP SYSTEM FOR A WELL

[75] Inventor: John C. Purcupile, Oklahoma City, Okla.

[73] Assignee: Board of Regents for the University of Oklahoma, Norman, Okla.

[21] Appl. No.: 608,710

[22] Filed: May 10, 1984

[51] Int. Cl.[4] ..... E21B 47/00

[52] U.S. Cl. ..... 73/151; 166/105; 166/250; 417/44; 417/290

[58] Field of Search ..... 73/151; 166/104, 105, 166/250; 417/44, 12, 212, 213, 279, 280, 290

[56] References Cited

U.S. PATENT DOCUMENTS

| | | | |
|---|---|---|---|
| 3,091,179 | 5/1963 | Echols | 417/44 |
| 3,105,443 | 10/1963 | Johnson | 417/44 |
| 3,359,791 | 12/1967 | Pantages | 73/151 |
| 3,765,234 | 10/1973 | Sievert | 73/151 |
| 3,817,094 | 6/1974 | Montgomery et al. | 73/151 |
| 3,824,851 | 7/1974 | Hagar | 73/151 |
| 3,838,597 | 10/1974 | Montgomery et al. | 73/151 |
| 3,926,047 | 12/1975 | Duke | 73/151 |
| 3,951,209 | 4/1976 | Gibbs | 73/151 |
| 4,015,469 | 4/1977 | Womack et al. | 73/151 |
| 4,034,808 | 7/1977 | Patterson | 73/151 |
| 4,058,757 | 11/1977 | Welton et al. | 73/151 |
| 4,090,405 | 5/1978 | McKee | 73/151 |
| 4,143,546 | 3/1979 | Wiener | 73/151 |
| 4,194,393 | 3/1980 | Boley | 73/151 |
| 4,483,188 | 11/1984 | McTamaney | 73/151 |
| 4,487,061 | 12/1984 | McTamaney et al. | 73/151 |

*Primary Examiner*—Howard A. Birmiel

*Attorney, Agent, or Firm*—Dunlap, Codding & Peterson

[57] ABSTRACT

Pulses produced by a pulse generator coupled to the output shaft of an electric motor that reciprocates a polish rod of a well pumping system are counted by a computer to locate the polish rod at a series of positions during each reciprocation of the polish rod and the dynamic load on the polish rod at each of these positions is determined by the computer from the time difference between pulses. The pulse count and dynamic loads are simultaneously displayed on a two-dimensional array of light emitting diodes under the control of the computer to visually present the dynamic pumping characteristics of the system. The operation of the system following pump off or breakage of a sucker rod is interrupted by controlling the operation of the motor via the computer, the computer switching off the motor following the occurrence of a preselected set of dynamic loads for a preselected set of pulses.

14 Claims, 5 Drawing Figures

APPARATUS AND METHOD FOR MONITORING AND CONTROLLING A PUMP SYSTEM FOR A WELL

BACKGROUND OF THE INVENTION

1. Field of the Invention

The present invention relates generally to improvements in the art of monitoring and controlling rod-pumped wells and, more particularly, but not by way of limitation, to methods for obtaining and utilizing the dynamic characteristics of a well pumping system.

2. Brief Description of the Prior Art

The pumping of oil wells is most commonly carried out using a pumping system that is comprised of a pump jack that operates a downhole pump. The pump jack has a walking beam that is oscillated in a vertical plane to reciprocate a polish rod that is suspended from one end of the walking beam and the polish rod is connected to the downhole pump via a plurality of sucker rods that extend in a string from the polish rod to the pump. The oscillation of the walking beam is accomplished by an electric motor having an output shaft that is connected through a suitable transmission to a crank that oscillates the walking beam as the motor output shaft turns. The pump jack is counterbalanced against the static load on the polish rod so that the motor can deliver power to the pump jack at a nearly constant rate related to the difference in the dynamic and static loads on the polish rod during the reciprocation of the polish rod.

While pumping systems of this type provide an effective means of pumping a well, such systems are also subject to a number of problems. A sucker rod might break or the pump might become stuck during the pumping of a well or the situation known as pump-off can occur. Pump-off occurs when the formation, or formations, from which liquids are entering the well cannot keep pace with the pump so that the liquid level in the well drops to the level of the downhole pump. Thereafter, if pumping is continued, the delivery of liquids from the well will be reduced with a consequent loss of efficiency of the pumping operation.

Of these problems, the loss of pumping efficiency due to pump-off has been the most difficult to deal with. A number of devices are available to detect a specific malfunction in the operation of a pumping system; for example, the breakage of a sucker rod, and shut down the system when the malfunction occurs. Pump-off on the other hand, has generally been dealt with by the intermittent operation of the pumping system based on measured dynamic characteristics of the system. The common practice is to obtain a plot of the dynamic load on the polish rod as a function of the polish rod location for each direction of travel of the polish rod as it reciprocates in the well and, from the dynamic characteristics, predict a schedule of operation of the pumping system that will prevent pump-off from occurring.

There are several difficulties with this approach. Initially, the dynamic characteristics of a pumping system depend upon factors such as the composition, density, viscosity and temperature of the well liquids and the size of the sucker rod and depth of the well. Some of these factors often change with time. Thus, a pumping schedule based on the dynamic characteristics of a pumping system at one time may very well not be suitable for pumping a well at a later time. Moreover, the intermittent operation approach based on a time schedule for pumping system operation is often inefficient.

Maximum efficiency of the operation of a pumping system occurs when the well is nearly pumped-off and no fixed time schedule can be established for a well such that this condition is met during the operation of the pumping system. Rather, as a practical matter, it has been necessary in the past to permit liquids to accumulate for long periods of time and then pump the well down. Finally, equipment used to measure the dynamic characteristics of a pumping system has, in the past, often been expensive.

Expense has also generally precluded attempts to achieve maximum efficiency of pumping operations by controlling a well such that the pumping system operates only under nearly pumped-off conditions. Because of the above-mentioned problems with intermittent, time-determined operation, some work has been directed toward the development of equipment which can detect pump-off and control the operation of the pumping system about pump-off. However, such work has not generally lead to the control of well pumping systems in part because of the cost of equipment involved in measuring the dynamic characteristics of well pumping systems. Also, such lack of development stems partly from the variation of the dynamic characteristics of a pumping system with time. In general, no well control system has been developed prior to the present invention that can economically control the operation of a well pumping system to continuously provide maximum efficiency of operation of the pumping system.

SUMMARY OF THE INVENTION

The present invention provides a method and apparatus for controlling the operation of a well pumping system that will maintain the operation of the system at maximum efficiency, despite variations in the dynamic characteristics of the system with time, and, concurrently, is sufficiently inexpensive to be employed with substantially any well pumping system. To this end, the apparatus is comprised of a rod location pulse generator that is coupled to an electric motor that drives the pumping system to provide an electrical rod location pulse each time the output shaft of the motor turns through one revolution, a synchronization signal generator that is coupled to the polish rod to provide one synchronization signal each time the polish rod reaches a preselected position while moving in one direction, a digital computer, and an output assembly that controls the operation of the electric motor. The output assembly, under the control of the computer, operates the motor at frequent intervals so that the operation of the pumping system is carried out in a nearly pumped-off condition of the well for maximum efficiency and can further be used to shut down the pumping system should a malfunction occur.

The method of the invention is based on the relationship between the output torque of the electric motor and the dynamic load on the polish rod, the relationship between the output torque of the motor and its operating speed, and the relationship between distance intervals through which the polish rod moves during a reciprocation and angles through which the motor output shaft moves in driving the polish rod through a reciprocation. In particular, because of the last of these relationships, each pulse produced by the rod location pulse generator following each synchronization signal corresponds to a particular location and direction of travel of the polish rod so that a sequence of rod location pulses provides a measure of the movement of the polish rod through a reciprocation. Concurrently, the time between each consecutive rod location pulses provides, first, a measure of the output torque of the motor that can be related to the polish rod location via the position of the pulses in the sequence following a synchronization signal and, secondly, a measure of the dynamic load on the polish rod that can similarly be related to the polish rod location. Thus, the apparatus of the present invention permits the operating characteristics of the well pumping system to be continuously monitored via a continuously generated relationship between the dynamic load on the polish rod and its location. This continuously generated relation can be used to control the well pumping system by the establishment of windows in the measured characteristics of the pumping system that indicate the occurrence of pump-off or a malfunction of the pumping system. Thus, the output assembly can be utilized, under the control of the computer, to provide control of the well pumping operation that will maximize efficiency of the pumping operation. Similarly, the apparatus of the present invention can be utilized to monitor the pumping operation so that the dynamic characteristics of the pumping system will always be known regardless of varying conditions that might occur in the well such as the density and temperature of well liquids. With this information, the windows used to control the operation of the electric motor can be periodically updated so that the well pumping operation can always be carried out at maximum efficiency.

An object of the present invention is to provide a method for operating a well pumping system that maximizes the efficiency of the pumping operation.

Another object of the invention is to provide inexpensive apparatus for controlling the pumping of a well.

Another object of the invention is to provide apparatus for controlling a pumping system for a well that can be readily adjusted to meet changing conditions in the well.

Yet a further object of the invention is to provide an inexpensive apparatus for controlling the pumping operation of a well capable of maintaining maximum efficiency of well pumping operations.

Other objects, advantages and features of the present invention will become clear from the following detailed description of the preferred embodiment of the invention when read in conjunction with the drawings and appended claims.

DESCRIPTION OF THE PREFERRED EMBODIMENT

Figure 1:
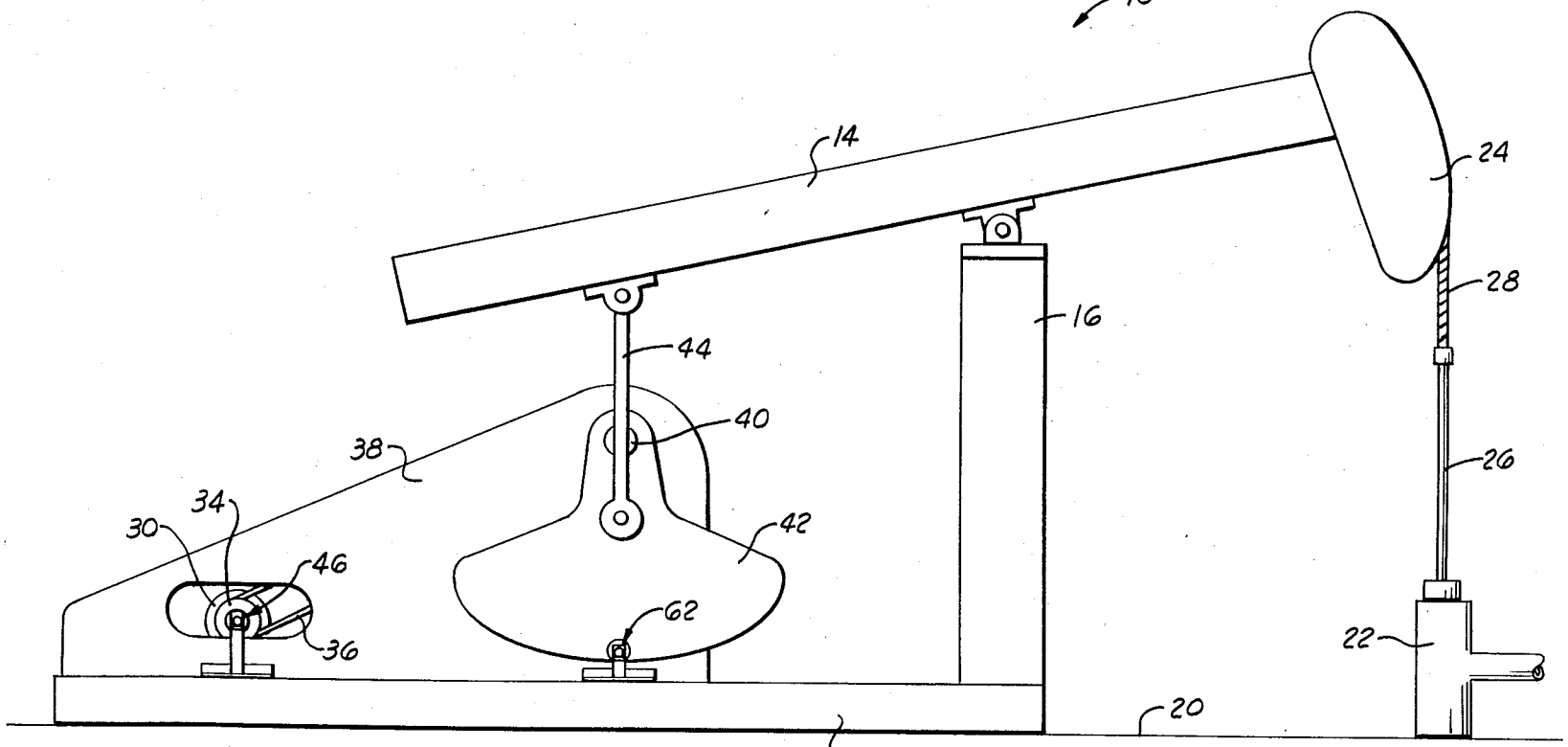
FIG. 1 is a schematic side elevational view of a pump jack illustrating the preferred mounting of the control and monitoring apparatus of the present invention on a pumping system.

Referring now to the drawings in general and to FIG. 1 in particular, shown therein and designated by the general reference numeral 10 is a pumping system, of the common pump jack type, which can be monitored and controlled using the method and apparatus of the present invention. Such apparatus has been schematically illustrated in FIG. 4, wherein the apparatus has been designated by the numeral 12, and portions of the apparatus have been illustrated in FIG. 1 to illustrate the preferred mounting of the apparatus 12 on a pumping system.

As illustrated in FIG. 1, the pumping system 10 comprises a walking beam 14 that is pivotally mounted atop a sampson post 16 that extends upwardly from a base 18 that rests on the earth's surface 20 adjacent a well 22. The walking beam 14 is mounted atop the sampson post 16 in the usual manner to oscillate in a vertical plane so that a horse head 24 mounted on one end of the walking beam will move in a vertical arc above the well 22. A polish rod 26 is suspended from the horse head 24 via a cable 28 to extend into the well 22 and a string of sucker rods (not shown) is connected to the lower end of the polish rod 26 to extend to a downhole pump (not shown) by means of which liquids are pumped from the well 22.

In order to oscillate the walking beam 14, the pumping system 10 includes an electric motor 30 having an output shaft 32 (FIG. 2) that is mechanically coupled to the walking beam 14 and, thence, to the polish rod 26. In particular, the output shaft 32 carries a sheave 34 that can be connected via a drive belt 36 to a conventional gear reducer (not shown) disposed, along with the sheave 34 and drive belt 36, within a shroud 38. The gear reducer terminates in a drive shaft 40 upon which a counterbalance 42 is mounted and a pitman arm 44 is connected between the walking beam 14 and the counterbalance 42, the pitman arm 44 being pivotally connected to each of the walking beam 14 and counterbalance 42 and being connected to the counterbalance 42 at a position displaced from the drive shaft 40 so that rotation of the counterbalance 42 will move one end of the pitman arm 44 in a circle to cause the other end of the pitman arm 44 to oscillate the walking beam 14 in the usual manner.

It will thus be seen that the rotation of the output shaft 32 of the motor 30 will result in a reciprocation of the polish rod 26. That is, as the output shaft 32 of the motor 30 rotates, the drive shaft 40 is rotated to move the pitman arm 44 in a manner that will oscillate the walking beam 14 so that the horse head 24 alternatively raises and lowers the polish rod 26. Moreover, because of the gear reducer (not shown) disposed in the connection between the output shaft 32 of the motor 30 and the drive shaft 40, the output shaft 32 will move through a large number of revolutions for each reciprocation of the polish rod 26. A typical number for the number of revolutions of the output shaft 32 per reciprocation of the polish rod 26 in a pumping system of the type illustrated in FIG. 1 is 150 revolutions per reciprocation. Additionally, because of the coupling between the motor output shaft 32 and the polish rod 26 provided by the belt 36, the gear reducer, the counterbalance 42, the pitman arm 44 and the walking beam 14, each revolution of the motor output shaft 32 corresponds to a substantially fixed displacement of the polish rod 26. (Some slippage may occur in the belt 36 but such slippage will not substantially effect the operation of the invention.)

The pumping system 10 shown in FIG. 1 has been selected to be of the pump jack type for purposes of illustration only. As will be clear from the description of the apparatus 12 to follow, it will be clear that the present invention is also usable with other types of pumping systems providing only that such systems are driven by an electric motor that causes the reciprocation of a polish rod such as the polish rod 26.

Figure 2:
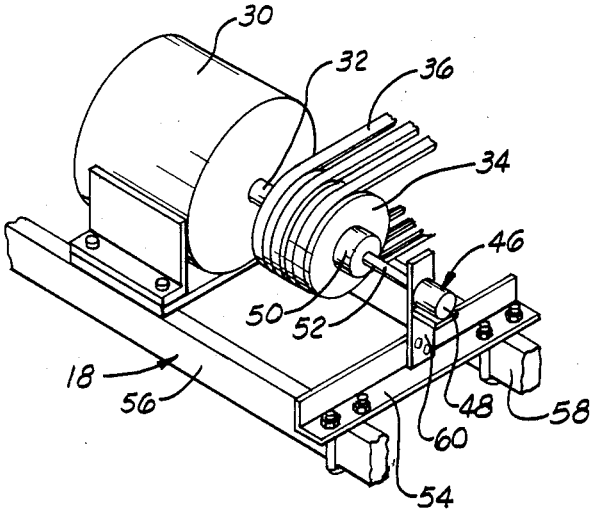
FIG. 2 is an enlarged view in partial cutaway of a portion of the pump jack of FIG. 1 illustrating the construction and mounting of a preferred form of rod location pulse generator of which the control and monitoring apparatus is comprised.

Turning now to FIG. 2, the apparatus 22 that is the subject of the present invention comprises a rod location pulse generator 46 that provides one electrical rod location pulse each time the motor output shaft 32 undergoes one revolution. A preferred form of rod location pulse generator comprises an optical encoder 48 that is connected to the motor output shaft 32 via a coupler 50 mounted on the motor output shaft 32 and a flexible shaft 52 connected between the coupler 50 and the optical encoder 48. The optical encoder is preferably a model N-1 optical encoder, stock number H-250-SS-10-ABZ-7406R-EM16 available from BEI Electronic, Inc., Industrial Encoder Division, Goleta, Calif. Such encoder has a rotatable input shaft (not shown) and is constructed to provide one, or more, electrical pulses each time such input shaft is turned through one revolution. Thus, the rod location pulse generator 46 can be used to follow the movement of the polish rod 26 by counting the pulses produced thereby beginning with a preselected location of the polish rod 26.

To mount the optical encoder 48 on the pump jack, a bracket 54, comprised of a length of angle stock, is connected to bolsters 56, 58 forming a portion of the pump jack base 18 and a support member 60 is attached to the bracket 54 to extend upwardly to a position in alignment with the motor output shaft 32. The encoder 48 is then mounted on the support member 60 with the input shaft of the encoder passing through a hole (not shown) in the member 60.

The apparatus 12 further comprises a synchronization signal generator 62 which generates one electrical synchronization pulse each time the polish rod 26 undergoes one reciprocation. To this end, the synchronization signal generator 62 is preferably mounted on the base 18 to detect the passage of the counterbalance 42 through its lowest point so that the synchronization pulse produced thereby occurs at a specific location of the polish rod 26. Thus, each synchronization pulse marks a specific point of the reciprocation of the polish rod 26 so that counting of rod location pulses produced by the rod location pulse generator can be initiated for a specific location of the polish rod 26.

Figure 3:
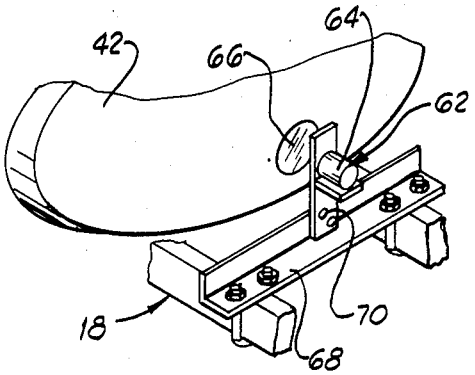
FIG. 3 is an enlarged view in partial cutaway of a portion of the pump jack of FIG. 1 illustrating the construction and mounting of a preferred form of synchronization signal generator of which the apparatus can be comprised.

A suitable construction for the synchronization signal generator 62 is based on the infrared sensor model S1, part number MLS8B, manufactured by Micro Switch Division of Honeywell, Inc., Freeport, Ill., such sensor being indicated at 64 in FIG. 3. Such sensor includes an infrared source and an infrared detector mounted in one end of a case to detect the presence of an infrared reflector. Such reflector, indicated at 66 in FIG. 3 is mounted on the counterbalance 42 and is a model 51, part number RR-1, target similarly manufactured by Micro Switch. Like the rod location pulse generator 42, the sensor of the synchronization signal generator 62 is mounted on the base 18 via a bracket 68 and support member 70.

Figure 4:
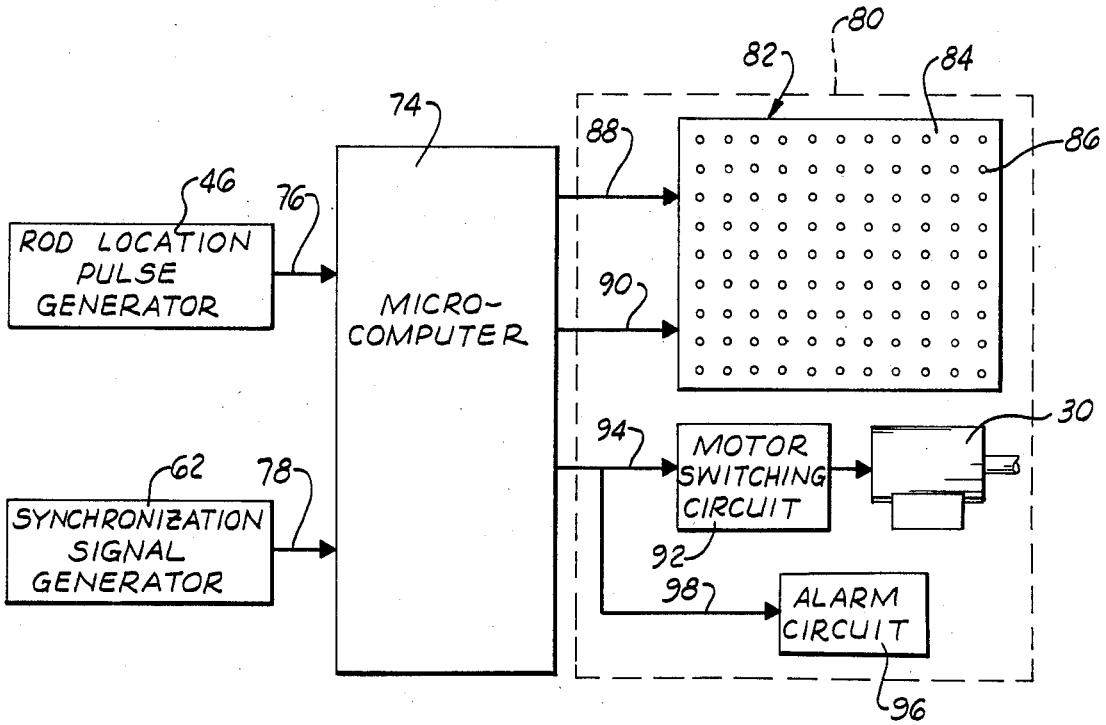
FIG. 4 is a schematic circuit diagram of the monitoring and control apparatus of the present invention.

The apparatus 12 further comprises a microcomputer 74 which is electrically connected to the rod location pulse generator 46 and the synchronization signal generator 62 to receive electrical pulses generated by the generators 46 and 62 on signal paths schematically indicated at 76 and 78 respectively in FIG. 4. The microcomputer 74 is programmed to count each sequence of pulses received from the pulse generator 46 following the reception of a pulse from the synchronization signal generator 62. Thus, since the synchronization signal generator 62 provides one pulse for each reciprocation of the polish rod 26 and since the rod location pulse generator 46 provides one pulse for each revolution of the motor shaft 32, the microcomputer 74 counts the revolutions of the motor shaft 32 corresponding to each reciprocation of the polish rod 26.

Moreover, since the synchronization signal generator 62 is coupled to the polish rod 26 so that each synchronization pulse occurs for a selected location of the polish rod 26, the rod location pulses in each sequence of such pulses corresponding to a reciprocation of the polish rod 26 mark substantially fixed locations of the polish rod 26. That is, the counts associated with a sequence of rod location pulses are in a one-to-one correspondence with a sequence of locations through which the polish rod 26 passes as the polish rod 26 reciprocates. In the practice of the present invention, such counts are used as a measure of the polish rod location in the generation and display of the dynamic characteristics of the pumping system 10 in a manner to be discussed below.

An important concept underlying the present invention is that the time interval between two consecutive rod location pulses will generally not be constant. Rather, such time depends upon a variety of factors including the average dynamic load on the polish rod 26 during the time interval between the two rod location pulses and upon the torque versus speed characteristics of the motor 30. That is, the greater the average dynamic load on the polish rod 26 during the time interval between two successive rod location pulses, the greater the average torque the motor shaft 32 must exert on the transmission of the pumping system 10 during such time interval and, correspondingly, the more slowly will the motor output shaft 32 turn during the movement of the polish rod 26 between the two locations corresponding to the two rod location pulses. Thus, in general, the greater the average dynamic load on the polish rod 26 during the time interval between two consecutive rod location pulses, the greater such time interval will be so that the time interval preceding the reception of a rod location pulse by the microcomputer 74, following the reception of the previous pulse, provides a measure of the average dynamic load on the polish rod 26. This average dynamic load, determinable from the time interval between pulses preceding each pulse, can be associated with the pulse to provide one point of a curve that approximates the dynamic characteristics of the pumping system 10. Based upon this concept, the microcomputer 74 is programmed to determine a dynamic load for each rod location pulse received thereby from the time interval between such rod location pulse and the preceding rod location pulse in a manner that will be discussed below. Thus, for each reciprocation of the polish rod 26, the microcomputer generates a sequence of rod location pulse counts, corresponding to a sequence of locations and directions of motion of the polish rod 26, and a sequence of dynamic loads on the polish rod 26 for the same sequence of locations of the polish rod 26.

In addition to the generators 46, 62 and the microcomputer 74, the apparatus 12 comprises an output assembly 80 that has been schematically illustrated in FIG. 4. In the preferred construction of the apparatus 12, the output assembly 80 comprises a display unit 82 having the form of a panel 84 in which is mounted a plurality of light emitting diodes 86. (Only one light emitting diode 86 has been numerically designated in FIG. 4.) The light emitting diodes 86 are arranged in a rectangular array so that the columns and rows of the array can be corresponded with the rod location pulse counts occurring in the microcomputer 74 during each reciprocation of the polish rod 26 and the dynamic loads determined for each of these pulse counts. In particular, the rows of light emitting diodes 86 are corresponded with a series of values of dynamic load selected with respect to the circumstances of operation of the pumping system 10 so that the range of such series will encompass the range of dynamic loads that will be exerted on the polish rod 26 during a reciprocation thereof. Similarly, the number of columns in the light emitting diode array is related to the number of rod location pulses corresponding to one reciprocation of the polish rod 26 so that each column of light emitting diodes 86 on the panel 84 can be corresponded with the counts for the rod location pulses that occur during a reciprocation of the polish rod 26. Preferably, the number of columns of the light emitting diodes in the array is chosen to be half the number of rod location pulses in one sequence of rod location pulses occurring for each reciprocation of the polish rod 26 so that each column in the array can be corresponded to a particular position of the polish rod 26, the polish rod reaching the position once while moving upwardly and once while moving downwardly.

The microcomputer 74 is connected to the display unit 82 via a bus 88 comprising a plurality of conductors equal in number to the number of columns in the light emitting diode array of the display unit 82 and the microcomputer 74 is programmed to provide enabling signals to all of the light emitting diodes 86 in each of the columns sequentially from right to left and then from left to right as the rod location pulses of each sequence of rod location pulses corresponding to a polish rod reciprocation are counted. (Such choice of correspondence of rod location pulse counts to columns of light emitting diodes is not essential; rather, it permits a display of the dynamic characteristics of the pumping system 10 by the display unit 82 that follows the conventional dynagraph.) Similarly, the microcomputer 74 is connected to the display unit 82 via a bus 90 having a number of conductors equal to the number of rows of light emitting diodes 86 in the diode array and the microcomputer 74 is programmed to provide a signal to a particular row of light emitting diodes 86 in the array each time a rod location pulse is received to cause the light emitting diode 86 in that row and concurrently in the enabled column of light emitting diodes to be supplied with electrical power so that such light emitting diode will illuminate. The row of light emitting diodes 86 receiving such signal in response to the reception of a rod location pulse by the microcomputer 74 is that row which has been corresponded to a dynamic load having the value nearest to the dynamic load determined by the microcomputer 74 for that particular pulse. Thus, as the polish rod 26 undergoes a reciprocation, a series of light emitting diodes 86 will be illuminated and such series will trace out a path on the display unit 82. The diode that is selected for each rod location pulse will be located along one axis thereof; that is, an axis extending along a row of light emitting diodes, to indicate the count of the rod location pulse, and the diode selected along the other axis of the array; that is, along the columns, will indicate the dynamic load on the polish rod that has been determined for the corresponding rod location pulse. With the folding of the rod location pulse count axis occasioned by corresponding each column of light emitting diodes to two rod location pulse counts for which the polish rod 26 is in one position, the path traced out by the sequence of light emitting diodes 86 that are illuminated will show the manner in which the dynamic load on the polish rod 26 varies with location of the polish rod 26 during each pumping cycle and for both directions of movement of the polish rod 26 during the pumping cycle in the same manner that such characteristics are displayed in a conventional dynagraph.

In addition to the display unit 82, the output assembly 80 comprises a motor switching circuit 92 by means of which power is supplied to the electric motor 30 that drives the polish rod 26. The motor switching circuit 92 is a conventional circuit that is responsive to a control signal received thereby on a signal path indicated at 94 in FIG. 4 to alternately interrupt the supply of power to the motor 30 or effect a resupply of power to the motor 30. That is, the switching circuit 92 has a toggle action that permits the motor 30 to be turned off and on by consecutive signals. Such switching circuits are well known in the art so that the circuit 92 need not be further discussed herein. The microcomputer 74 is programmed to supply the control signal on the signal path 94 each time a control condition, defined on the basis of the existence of a preselected dynamic load, as determined by the microcomputer, for selected ones of the rod location pulses occurs so that the apparatus 12 can be used to interrupt the operation of the motor 30 should pump-off occur or should a sucker rod break in a manner that will be discussed below.

In addition to the display unit 82 and the motor switching circuit 92, the apparatus 12 can also comprise an alarm circuit 96 to alert personnel monitoring the operation of the pumping system 10 should an event occur for which the microcomputer 74 has been programmed to interrupt the operation of the motor 30. Such alarm circuit can be comprised of any sound or light producing device and can be connected to the signal path 94 via a signal path 98 so that the generation of the control signal by the microcomputer 74 and transmission of such control signal to the motor switching circuit 92 will simultaneously activate the alarm circuit 96.

CALIBRATION OF THE PREFERRED EMBODIMENT

In order to use the apparatus 12 to monitor, control, or monitor and control the operation of the pumping system 10, the apparatus 12 is calibrated in a manner that will now be discussed. Initially, the torque versus speed characteristics of the motor 30 are obtained, either with a dynamometer or from the manufacturer, and such characteristics are entered into the memory of the microcomputer 74 in the form of a table that specifies the torque exerted by the motor 30 for selected periods of revolution of the output shaft 32 of the motor 30. The periods for which such table is formulated is selected to cover a range of periods that is greater than the range of numerical values of the time intervals between successive rod location pulses during the reciprocation of the polish rod 26 and the table is formulated by picking a plurality of periods of revolutions, determining the rotation speed of the motor output shaft 32 for each of these periods, and then referring to the torque versus speed characteristics of the motor to determine the torque exerted by the motor for each of the selected periods of rotation. Thus, the torque exerted by the motor 32 for each of the rod location pulses can be approximately determined by comparing the measured time of revolution of the motor between such pulse and the previous rod location pulse with periods in the table stored in the memory of the microcomputer 74. This torque, determinable for each rod location pulse received by the microcomputer 74, can be used to generate an approximate dynamic load on the polish rod 26 for the revolution preceding the reception of the rod location pulse.

Initially, it will be recognized that the torque exerted by the motor 30 will depend upon the position of the polish rod 26 as well as upon the state of motion of the polish rod 26. Under static conditions, the torque exerted by the motor 30 will have a value which can be expressed by the symbol $T_O(n)$ where the zero subscript for the torque indicates that such torque is the torque under static conditions and the quantity n is a parameter that specifies the location of the polish rod 26. In particular, the quantity n is chosen to be the number of revolutions through which the motor output shaft 32 has turned during the movement of the polish rod from the position thereof at which a synchronization signal is received by the microcomputer 74. In this case, when the pumping system 10 is operated, the parameter n that specifies the location of the polish rod 26 will be the count for the rod location pulses that are received by the microcomputer 74. The value of the torque, under static conditions, for the sequence of positions corresponding to the rod location pulse count numbers during each reciprocation of the polish rod 26 can be readily determined by manually moving the polish rod 26 through one reciprocation using a torque wrench connected to the output shaft 32 of the motor 30. The measurement of the static torque corresponding to each revolution of the motor output shaft 32 from a reference position of the polish rod 26 is a part of the calibration of the apparatus 12 and the measured static torques are entered into the memory of the microcomputer 74 in tabular form so that the microcomputer 74 can be programmed to determine the difference between the torque exerted under dynamic conditions while the pumping system 10 is operating and the torque that the motor would exert under static conditions for each of the rod location pulses.

It will be further recognized that the difference in the torque exerted by the motor 30 under dynamic conditions and the torque exerted by the motor 30 under static conditions for any location of the polish rod 26 will be functionally related to the difference between the dynamic load on the polish rod 26 and the static load on the polish rod 26 at the same position. Thus, it is possible to determine the difference between the dynamic and static loads on the polish rod 26 from the dynamic and static torques exerted by the motor 30 measured as described above once the relationship between torque difference and load difference is known. In the practice of the present invention, it is not necessary that this relationship be exactly known. Rather, it will suffice for purposes of monitoring and controlling the pumping system 10 to determine only an approximate dynamic load for a sequence of positions of the polish rod 26 corresponding to the reception by the microcomputer 74 of the sequence of rod location pulses corresponding to one reciprocation of the polish rod 26. In particular, it will suffice to approximate the relationship between the dynamic and static loads and the dynamic and static torques by the equation:

$$L(n)-L_O=a(n)[T(n)-T_O(n)], \quad (1)$$

where L(n) is the dynamic load on the polish rod for the time interval between successive receptions of rod location pulses corresponding to the nth rod location pulse, $L_O$ is the static load on the polish rod 26, T(n) is the torque exerted by the motor 30 in the time interval preceding reception of the nth rod location pulse by the microcomputer 74 and corresponding to n revolutions of the motor output shaft 32 from a preselected reference position of the polish rod 26 and $T_O(n)$ is the torque that has been measured for the nth revolution of the motor output shaft 32 from the position at which the polish rod 26 is in the reference position thereof, and a(n) is a parameter that is adjusted for each rod location pulse count to cause the equation to match the dynamic characteristics of the pumping system. The final step of calibration of the apparatus 12 is to determine the values of a(n) for the pumping system 10 while the pumping system 10 is operating.

Figure 5:
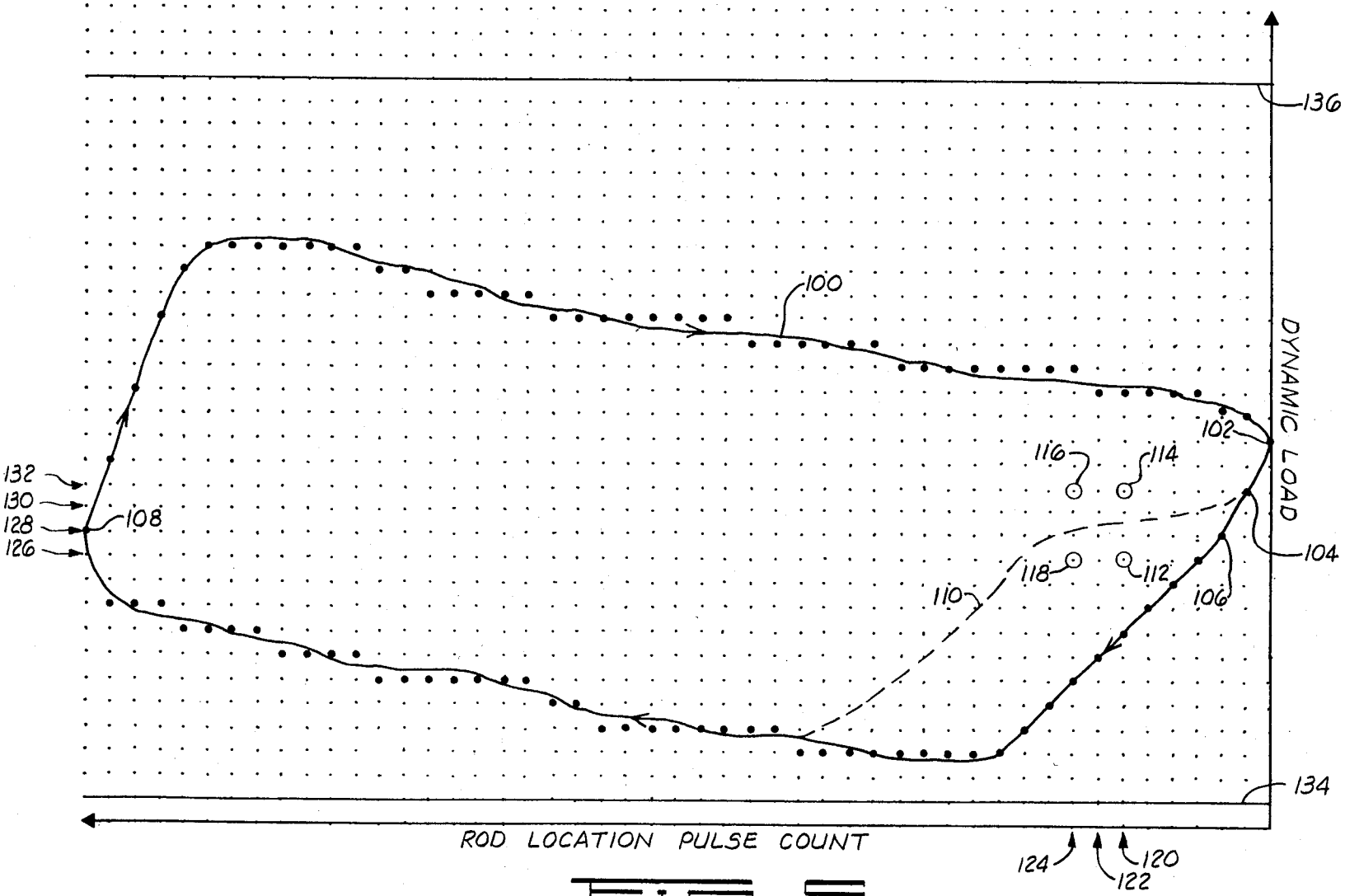
FIG. 5 is a graphical representation of the operating characteristics of a pumping system superimposed on a representation of a display assembly of which the apparatus is comprised to illustrate the display of the operating characteristics of a pumping system and the control of the pumping system.

FIG. 5 has been included to illustrate the manner in which the values a(n) are determined to complete calibration of the apparatus 12 and to further illustrate the operation of the apparatus 12. Shown in such Figure and designated by the numeral 100 is a curve illustrating the typical dynamic characteristics of a well pumping system during one reciprocation of the polish 26 with dynamic load being plotted along the ordinate and polish rod location being plotted along the abscissa. Since, as noted above, each rod location pulse count corresponds to a specific location of the polish rod 26, the unit of measure of polish rod location in FIG. 5 has been selected to be units of counting for the rod location pulses so that the abscissa has been marked rod location pulse count in FIG. 5. The units of measure for the dynamic load on the polish rod 26 can be any conventional measure of force.

Superimposed on the dynamic characteristics plot shown in FIG. 5 is an array of equally spaced points that correspond to the locations of the light emitting diodes 86 on the panel 84 of the display unit 82. (The number of such points in FIG. 5 has been reduced from the number of light emitting diodes that would normally be used in the practice of the invention for clarity of illustration; for example, where the motor output shaft 32 turns through 150 revolutions per reciprocation of the polish rod 26 and one rod location pulse is produced per revolution of the motor output shaft 32, the display unit 82 would include 75 columns of diodes, corresponding to 75 positions of the polish rod 26 as the polish rod 26 moved downwardly and then upwardly, as opposed to the 48 columns of points shown in FIG. 5. Additionally, the optical encoder 48 can be used to generate several rod location pulses for each revolution of the motor output shaft 32 so that many more columns of points than the number shown in FIG. 5 could be utilized in the practice of the present invention.) The right hand column of points in FIG. 5 corresponds to the first rod location pulse received following the reception of a synchronization pulse so that the right hand column of points corresponds to the position of the polish rod shown in FIG. 1. Each succeeding column from right to left in FIG. 5 corresponds to the position of the polish rod 26 as the polish rod 26 moves downwardly so that the final column corresponds to the position of the polish rod 26 at its lowest point in the well. Such position occurs for the center rod location pulse of a sequence of pulses generated by the rod location pulse generator 46 following the reception by the microcomputer 74 of a synchronization pulse and succeeding pulses generated by the rod location pulse generator 46 are corresponded with the columns from left to right in FIG. 5 so that each column in FIG. 5 corresponds to one location of the polish rod 26 for both directions of travel of the polish rod 26.

The curve 100 in FIG. 5 is typical of the sort of dynamic characteristics that would be measured for a pumping system such as the pumping system 10 during normal operation of the system at such times that pump-off is not occurring. To calibrate the apparatus 12, a curve such as the curve 100 is obtained using conventional methods and calibration of the apparatus 12 is effected by selecting the values of the quantities a(n) to cause the sequence of light emitting diodes that illuminate for a reciprocation of the polish rod 26, such diodes being determined by the pulse count of each member of a sequence of rod location pulses and the corresponding dynamic loads determined in accordance with equation (1) above, to trace out on the display unit 82 substantially the same curve as the dynamic characteristic curve that has been measured using conventional methods. Thus, when the dynamic characteristics are those shown by the curve 100, with the arrows on the curve indicating the sequence of dynamic load versus polish rod position values of the dynamic characteristics as the polish rod 26 moves through a reciprocation from the position shown in FIG. 1, the quantities a(1), a(2) and a(3) would be selected and entered into the microcomputer 74 to cause diodes located at points indicated by solid circles 102, 104 and 106 respectively in FIG. 5 to illuminate so that the first three diodes to be illuminated would trace out a portion of the curve 100 as illustrated. This scheme of determining the quantities a(n) is continued with further selections of the values of the quantities a(n) to cause diodes along the lower half of the curve 100 to illuminate as the polish rod moves downwardly so that the sequence of illuminated diodes, as indicated by solid circles along the lower half of the curve 100, trace out the lower half of the curve 100 as the polish rod moves downwardly to a lowermost position as indicated by the solid circle at the point 108 in FIG. 5. As the polish rod rises, values of a(n) are selected and entered into the microcomputer 74 to correspond to rod location pulse counts so that diodes located by solid circles along the upper half of the curve 100 will illuminate sequentially as the polish rod 26 rises and such diodes will sequentially trace out the upper half of the curve 100 as shown in FIG. 5. Once the values of the quantities a(n) have been so selected, the apparatus 12 is calibrated.

OPERATION OF THE PREFERRED EMBODIMENT

As has been noted above, the apparatus 12 can be utilized both to monitor and control the operation of the pumping system 10. For monitoring, the completion of calibration of the apparatus 12 is the last active step that need be taken in the use of such apparatus. That is, as time passes, the synchronization signal generator 62 will generate a synchronization signal each time the counterbalance 42 passes through its lowermost position and transmit such signal on the signal path 78 to the microcomputer 74. With the reception of the synchronization pulse 78, the microcomputer 74 begins to count rod location pulses that are transmitted to the microcomputer 74 on the signal path 76 from the rod location pulse generator 46. The microcomputer 74 is programmed to output a signal on one of the conducting paths of the bus 88 each time a new rod location pulse is received in a sequence beginning with the reception of a synchronization pulse so that the successive columns of light emitting diodes 86 from right to left and then from left to right across the display unit 82 are enabled to illuminate. Concurrently with the reception of each rod location pulses generator in a sequence beginning with the reception of a synchronization pulse, the microcomputer 74 determines a dynamic load on the polish rod 26 in accordance with equation (1) above from the time interval between such rod location pulse and the previously received rod location pulse and outputs a signal on one of the conducting paths of the bus 90 to cause a particular one of the light emitting diodes in a column corresponding to the rod location pulse count to illuminate. Thus, as the polish rod 26 reciprocates, a sequence of light emitting diodes will be illuminated to illustrate the dynamic characteristics of the pumping system 10 in the manner that the solid circles in FIG. 5 trace out the dynamic curve 100.

For control purposes, the microcomputer 74 is programmed to recognize a variety of control conditions defined by selected concurrences of rod location pulse counts and dynamic loads determined in accordance with the calibrated equation (1) above. These control conditions each indicate specific aspects of the operation of a pumping system and the microcomputer 74 is programmed to provide a control signal on the signal path 94 to the motor switching circuit 92 each time one of these control conditions occurs. The manner in which several control conditions are defined by concurrences of rod location pulse counts and dynamic loads have been illustrated in FIG. 5.

Initially, it has been observed that the occurrence of pump-off in a well is accompanied by a consistent change in the dynamic pumping characteristics of a pumping system and such change has been illustrated by the dashed line 110 in FIG. 5. In particular, once the onset of pump-off occurs, the dynamic load on the polish rod 26 near the uppermost position of the polish rod 26 changes to define a plateau that removes the lower right hand corner of the curve 100. If the pumping system continues to operate, the plateau grows in extent toward the left hand side of the curve 100 until eventually the entire lower half of the pumping characteristic curve becomes essentially a straight line above the non-pump-off curve 100 that has been illustrated in FIG. 5. Accordingly, the onset of pump-off can be detected by the condition that the dynamic characteristic curve following pump-off pass through a preselected window defined by selected values of the dynamic load for selected counts of rod location pulses. Graphically, such a window can be specified by the open circles 112–118 in FIG. 5, such circles indicating selected dynamic loads on the polish rod 26 for selected rod location pulse counts occuring shortly after the polish rod reaches its maximum height during a reciprocation of the polish rod 26. Such points are selected by permitting pump-off to occur while monitoring the operation of the pumping system using the display unit 82 and are entered into the microcomputer 74. The microcomputer 74 is programmed to provide a control signal at any time that the dynamic characteristics of the pumping system, as measured by the apparatus 12, pass through the window, such is the window defined by the points 112–118 selected to indicate pump-off, several times in succession. That is, the control signal is provided if the dynamic load determined by the computer for a preselected set of rod location pulses, indicated in FIG. 5 by the columns 120–124 of points, have preselected values corresponding to the rows 126–132 in FIG. 5. Thus, the apparatus 12 has a capability of providing a control signal to the motor switching circuit 92 at the onset of pump-off to cause the motor 30 to discontinue operation with the onset of pump-off. The present invention contemplates that such capability will be exploited to maintain the operation of the pumping system 10 in nearly pumped-off conditions of the well 22. In particular, the present invention contemplates that the microcomputer 74 will be programmed to provide one control signal to the motor switching circuit when the dynamic characteristics of the pumping system pass through the window corresponding to pump-off several times in succession and to provide a second control signal to the motor switching circuit 92 a short time such as one minute later. If the entry of liquids into the well has not been sufficient during such short time period that the pumping system 10 does not operate to place the well in a condition in which pump-off is imminent, the dynamic characteristics of the pumping system 10 will again pass through the window defining the pump-off control condition so that the microcomputer 74 will again interrupt the operation of the motor 30. Thus, the microcomputer 74 continually tests the pumping system 10 to determine whether the well is in a nearly pumped-off condition and operates the pumping system 10 to cause pumping only when pump-off is imminent and has begun to occur. By this means, the apparatus 12 ensures maximum efficiency of operation of the pumping system 10.

A second control condition is illustrated by the line 134 drawn along the lower portion of FIG. 5. Such line indicates a dynamic load on the polish rod 26 that is lower than any dynamic load that can be expected during normal operation of the pumping system 10 whether or not pump-off has occurred. Moreover, such load can be selected to be considerably lower than the static load on the polish rod 26 so that such load cannot occur while the sucker rod string to the downhole pump is intact. Thus, the line 134 is a load that corresponds to breakage of one of the sucker rods to the downhole pump or to the polish rod. The microcomputer 74 is programmed in the conduct of the present invention to provide a control signal to the motor switching circuit 92 should the dynamic load determined in accordance with equation (1) above for any rod location pulse count fall below the load indicated by the line 120 and to provide no subsequent control signal to the motor switching circuit until the microcomputer 74 receives a reset signal that is entered manually into the microcomputer 74. Thus, the apparatus 12 further has the capability of detecting the breakage of a sucker rod and interrupting the operation of the motor 30 when such breakage occurs.

The line 136 in FIG. 5 indicates a dynamic load that is higher than any load that could reasonably be on the polish rod 26 during normal operation of the pumping system 10 so that the selection of such a dynamic load permits the microcomputer 74 to be programmed to interrupt the operation of the pumping system 10 should the downhole pump thereof stick. In particular, the microcomputer 74 is programmed to provide a control signal to the motor switching circuit 92 any time an excessive load on the polish rod 26, as indicated by the determination of a dynamic load via the equation (1) above that exceeds a selected value such as the value indicated by the line 136 for any rod location pulse count. Similarly, the microcomputer 74 is programmed so that no additional control signals will be transmitted to the motor switching circuit 92 following the transmission of a control signal in response to a dynamic load that indicates that the pump is stuck until the microcomputer 74 has been manually reset. Thus, the present invention also provides a method for controlling the operation of a pumping system such that such operation is interrupted should sticking of the downhole pump of the system occur.

A suitable microcomputer for use in the apparatus 12 is an SDK-85 by Intel Corporation of Santa Clara, Calif. A program for the microcomputer, where such type is used in the apparatus 12, is as follows:

Dynagraph Display Program

| Memory Address (Hex) | Instruction (Mnemonic) | Memory Contents (Hex) | Comments |
|---|---|---|---|
| 1000 | LXI SP 20C2 | 31 | Initialize Stack Pointer |
| 1 | | C2 | |
| 2 | | 20 | |
| 3 | MUIA,OFH | 3E | Make Ports 21, 22, and |
| 4 | | OF | 23 OUTPUT PORTS |
| 5 | OUT2OH | D3 | |
| 6 | | 20 | |
| 7 | SUBA | 97 | Make Ports 29 and 2A |
| 8 | OUT 28A | D3 | INPUT PORTS |
| 9 | | 28 | |
| A | MOVL,A | 6F | Establish pointer @ |
| B | MVIH,15H | 26 | Beginning of TDC converted |
| 7 | | xx | |
| 8 | | xx | |
| 9 | | xx | |
| A | | xx | |
| B | | xx | |
| C | | xx | |
| D | | xx | |
| E | | xx | |
| F | | xx | |
| 50 | INRH | 24 | Get Stored Value of static torque/time measurement |
| 1 | MOVB,M | 46 | |
| 2 | DCRH | 25 | |
| 3 | IN29H | DB | Get Constant C1 from Input PORT 29 |
| 4 | | 29 | |
| 5 | MOVC,A | 4F | Store C1 in Register C |
| 6 | MOVA,D | 7A | Move current time into A |
| 7 | SUBB | 90 | Subtract stored value from current |
| 8 | ADDC | 81 | Add C1 for desired vertical shift |

-continued

Dynagraph Display Program

| Memory Address (Hex) | Instruction (Mnemonic) | Memory Contents (Hex) | Comments |
|---|---|---|---|
| 9 | MOVB,A | 47 | Move this value into B register |
| A | IN2AH | DB | Get constant C2 from Input PORT 2A |
| B | | 2A | |
| C | MOVC,A | 4F | Move to Register C |
| D | CALL MULT | CD | Call Subroutine MULT |
| E | | AO | that multiplies the values stored in |
| F | | 10 | Registers B and C |
| 1060 | RRC | 1F | Move this final LOAD |
| 1 | RRC | 1F | value into proper |
| 2 | RRC | 1F | alignment for output to |
| 3 | RRC | 1F | vertical axis of Dynagraph Display |
| 4 | OUT22H | D3 | Energize appropriate |
| 5 | | 22 | ROW for display of current Load |
| 6 | JMP 1070 | C3 | |
| 7 | | 70 | |
| 8 | | 10 | |
| 9 | | xx | |
| A | | xx | |
| B | | xx | |
| C | | xx | |
| D | | xx | |
| E | | xx | |
| F | | xx | |
| 70 | MOVA,M | 7E | Get prestored column pointer |
| 1 | OUT 21H | D3 | Energize appropriate |
| 2 | | 21 | Column for display of current Position |
| 3 | MVIA,09 | 3E | Enable both interrupts |
| 4 | | 09 | RSI 6.5 Synch and |
| 5 | SIM | 30 | RST 7.5 shaft |
| 6 | EI | FB | Wait: SEE VECTOR-ED INTR. SUB. |
| 7 | HLT | 76 | for instruction after either interrupt |
| 8 | JMP TOP | C3 | Return to cycle beginning |
| 9 | | 20 | |
| A | | 10 | |
| B | | xx | |
| C | | xx | |
| D | | xx | |
| E | | xx | |
| F | | xx | |
| C | | 15 | Torque values |
| D | NOP | 00 | |
| E | NOP | 00 | |
| F | NOP | 00 | |
| 1010 | MUIA,ODH | 3E | Enable Synch Pulse Interrupt |
| 1 | | OD | (RST6.5) |
| 2 | SIM | 30 | Wait |
| 3 | EI | FB | Wait |
| 4 | HLT | 76 | Proceed on Snych Pulse Receipt |
| 5 | MVIA,OBH | 3E | Enable Shaft Pulse Interrupt |
| 6 | | OB | (RST7.5) |
| 7 | SIM | 30 | Wait |
| 8 | EI | FB | Wait |
| 9 | HLT | 76 | Proceed on Shaft Pulse Receipt |
| A | NOP | 00 | |
| B | NOP | 00 | |
| C | NOP | 00 | |
| D | NOP | 00 | |
| E | NOP | 00 | |
| F | NOP | 00 | |
| 1020 | TOP: MUIA,40H | 3E | STOP Down Counter |
| 1 | | 40 | |
| 2 | OUT28H | D3 | |
| 3 | | 28 | |

-continued

Dynagraph Display Program

| Memory Address (Hex) | Instruction (Mnemonic) | Memory Contents (Hex) | Comments |
|---|---|---|---|
| 4 | IN2DH | DB | Move MSB (most significant byte) of current count into D register |
| 5 | | 2D | |
| 6 | MOVD,A | 57 | |
| 7 | IN2CH | DB | Move LSB into E register |
| 8 | | 2C | |
| 9 | MOVE,A | 5F | |
| A | MUIA,90H | 3E | Reload Counter with |
| B | | 99 | Predetermined starting count value |
| C | OUT 2CH | D3 | (3990 H) and establish |
| D | | 2C | counter mode |
| E | MUIA,F9H | 3E | |
| F | | F9 | Initialize Stack Pointer |
| 30 | OUT2DH | D3 | |
| 1 | | 2D | |
| 2 | MUIA,COH | 3E | Restart Counter |
| 3 | | CO | |
| 4 | OUT28H | D3 | |
| 5 | 28 | 28 | |
| 6 | JMP 1040H | C3 | Jump to Remainder of Program |
| 7 | | 40 | |
| 8 | | 10 | |
| 9 | | xx | |
| A | | xx | |
| B | | xx | |
| C | | xx | |
| D | | xx | |
| E | | xx | |
| F | | xx | |
| 1040 | XCHG | EB | SHIFT 8MS Bits into D Register |
| 1 | DADH | 29 | |
| 2 | DADH | 29 | |
| 3 | XCHG | EB | |
| 4 | JMP1050H | C3 | |
| 5 | | 50 | |
| 6 | | 10 | |
| MULTI | | | |
| 10A0 | SUBA | 97 | CLEAR SUM |
| 1 | SUM: ADD B | 80 | ADD B to B, C times |
| 2 | DCR C | OD | |
| 3 | JNZ SUM | C2 | |
| 4 | | A1 | Return to program when finished |
| 5 | | 10 | Product in A |
| 6 | RET | C9 | |
| VECTORED INTERRUPTS | | | |
| 1. Upon receipt of RST 6.5 (synch pulse) | | | |
| 20C8 | SUBA | 97 | Return pointer to TDC position |
| 20C9 | MOVL,A | 6F | |
| 20CA | RET | C9 | |
| 2. Upon receipt of RST 7.5 (shaft pulse) | | | |
| 20CE | INRL | 2C | Increment pointer to |
| 20CF | RET | C9 | next shaft cycle position |

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An apparatus usable with a pumping system of the type having a polish rod that is reciprocated by an electric motor to pump a well, the motor having an output shaft mechanically coupled to said polish rod to move the polish rod through one reciprocation for a plurality of revolutions of the motor output shaft, comprising:

synchronization signal generator means coupled to the polish rod for generating a synchronization signal for each reciprocation of the polish rod;

rod location pulse generator means coupled to the output shaft of the motor for generating at least one electrical rod location pulse each time the motor output shaft turns through one revolution, whereby the rod location pulse generator means provides a sequence of rod location pulses following each synchronization signal, each sequence of rod location pulses corresponding to one reciprocation of the polish rod and each member of a sequence of rod location pulses corresponding to a particular position and direction of travel of the polish rod;

a computer electrically connected to the pulse generator means to receive said rod location pulses and said synchronization signals, wherein the computer is programmed to count the rod location pulses constituting each sequence, to measure the time interval between each two consecutive rod location pulses received by the computer, and to determine a dynamic load on the polish rod for each rod location pulse of each sequence from the time interval between reception of such rod position pulse and the reception of the preceding rod location pulse, whereby the totality of rod location pulse counts and corresponding dynamic loads for each sequence of rod location pulses received by the computer provides an indiction of the operating characteristics of the pumping system and;

output means electrically connected to the computer and controlled thereby for providing at least one of a continuous display of the pumping system operating characteristics and an interruption of the operation of the motor at such times that the pumping system operating characteristics satisfy a preselected control condition.

2. The apparatus of claim 1 wherein the output means comprises display means for providing a visual indication of a rod location pulse count concurrently with a visual indication of a dynamic load on the polish rod and wherein the computer is programmed to provide the display means with the rod location pulse count and dynamic load corresponding to each rod location pulse each time a rod location pulse is received by the computer.

3. The apparatus of claim 2 wherein said computer is further programmed to generate a control signal in response to the occurrence of a preselected set of dynamic loads for a preselected set of rod position pulses of a sequence; and wherein the output means comprises switching means connected to the computer to receive the control signal and connected to the motor for interrupting the operation of the motor in response to the reception by the switching means of said control signal.

4. The apparatus of claim 3 wherein the output means further comprises alarm means connected to the computer to receive the control signal for providing an alarm in response to reception by the alarm means of said control signal.

5. The apparatus of claim 3 wherein the display means comprises a two-dimensional array of light emitting diodes; and wherein the computer is programmed to provide an electrical signal to a selected diode of said array for each rod position pulse, the position of the selected diode along one axis of the array indicating the count of the rod location pulse in a sequence of rod location pulses and the position of the selected diode along another axis of the array indicating the dynamic load determined for such rod location pulse.

6. The apparatus of claim 2 wherein the display means comprises a two-dimensional array of light emitting diodes; and wherein the computer is programmed to provide an electrical signal to a selected diode of said array for each rod position pulse, the position of the selected diode along one axis of the array indicating the count of the rod location pulse in a sequence of rod location pulses and the position of the selected diode along another axis of the array indicating the dynamic load determined for such rod location pulse.

7. The apparatus of claim 1 wherein said computer is further programmed to generate a control signal in response to the occurrence of a preselected set of dynamic loads for a preselected set of rod position pulses of a sequence; and wherein the output means comprises switching means connected to the computer to receive the control signal and connected to the motor for interrupting the operation of the motor in response to the reception by the switching means of said control signal.

8. The apparatus of claim 7 further comprising alarm means connected to the computer to receive the control signal for providing an alarm in response to reception by the alarm means of said control signal.

9. A method for monitoring the operation of a pumping system having a polish rod that is reciprocated by an electric motor to pump a well, the motor having an output shaft mechanically coupled to said polish rod to move the polish rod through one reciprocation for a plurality of revolutions of the motor output shaft, comprising the steps of:

electronically counting the revolutions of the motor output shaft for each reciprocation of the polish rod;

electronically measuring the time required for each revolution of the motor output shaft;

electronically determining a dynamic load on the polish rod for each counted revolution of the motor output shaft from the time required for such revolution; and simultaneously providing a visual indication of the motor output shaft revolution count and dynamic load corresponding to each such motor shaft revolution count for each reciprocation of the polish rod.

10. The method of claim 9 further comprising the step of interrupting the operation of the motor following the occurrence of a preselected set of dynamic loads on the polish rod for a preselected set of revolutions of the motor shaft in a sequence of revolutions corresponding to one reciprocation of the polish rod.

11. The method of claim 10 further comprising the step of providing an alarm following said occurrence of a preselected set of dynamic loads on the polish rod for said preselected set of revolutions of the motor shaft.

12. The method of claim 9 wherein the step of electronically counting the revolutions of the motor output shaft for each reciprocation of the polish rod comprises the steps of:

detecting a preselected position and direction of travel of the polish rod for each reciprocation of the polish rod; and electronically counting the revolutions of the motor output shaft between consecutive detections of the position and direction of travel of the polish rod.

13. A method for controlling the operation of a pumping system having a polish rod that is reciprocated by an electric motor to pump a well, the motor having an output shaft mechanically coupled to said polish rod to move the polish rod through one reciprocation for a plurality of revolutions of the motor output shaft, comprising the steps of:

electronically counting the revolutions of the motor output shaft for each reciprocation of the polish rod;

electronically measuring the time required for each revolution of the motor output shaft;

electronically determining a dynamic load on the polish rod for each counted revolution of the motor output shaft from the time required for such revolution; and interrupting the operation of the motor following the occurrence of a preselected set of dynamic loads on the polish rod for a preselected set of revolutions of the motor shaft in a sequence of revolutions corresponding to one reciprocation of the polish rod.

14. The method of claim 13 wherein the step of electronically counting the revolutions of the motor output shaft for each reciprocation of the polish rod comprises the steps of:

detecting a preselected position and direction of travel of the polish rod for each reciprocation of the polish rod; and electroncially counting the revolutions of the motor output shaft between consecutive detections of the position and direction of travel of the polish rod.

* * * * *